United States Patent [19]

Nakayama

[11] Patent Number: 4,957,461

[45] Date of Patent: Sep. 18, 1990

[54] IDLING NOISE SILENCER FOR MARINE PROPULSION UNIT

[75] Inventor: Manabu Nakayama, Hamamatsu, Japan

[73] Assignee: Sanshin Kogyo Kabushiki Kaisha, Hamamatsuo, Japan

[21] Appl. No.: 278,973

[22] Filed: Dec. 2, 1988

[30] Foreign Application Priority Data

Dec. 2, 1987 [JP] Japan ..... 62-304771

[51] Int. Cl.[5] ..... B63H 21/32

[52] U.S. Cl. ..... 440/89; 204/147

[58] Field of Search ..... 440/88, 89, 57–61; 60/310; 204/147

[56] References Cited

U.S. PATENT DOCUMENTS 3,183,880 5/1965 Shimanckas ..... 440/88

3,893,407 7/1975 Hurst ..... 440/57

FOREIGN PATENT DOCUMENTS 379453 7/1973 U.S.S.R. ..... 440/89

*Primary Examiner*—Joseph F. Peters, Jr.

*Assistant Examiner*—Jesus D. Sotelo

*Attorney, Agent, or Firm*—Ernest A. Beutler

[57] ABSTRACT

A marine outboard drive including an exhaust system that includes a baffle plate which is disposed across the low speed exhaust gas opening and which defines a plurality of ribs to break up the exhaust gas bubbles during idling for silencing. The baffle plate is formed as a sacrificial anode so as to offer galvanic protection and to permit ease of replacement.

8 Claims, 4 Drawing Sheets

IDLING NOISE SILENCER FOR MARINE PROPULSION UNIT

BACKGROUND OF THE INVENTION

This invention relates to an idling noise silencer for a marine propulsion unit and more particularly to an improved arrangement for silencing the idling noises of a marine propulsion unit and for preventing corrosion through the use of a sacrificial anode.

The treatment of exhaust gases in marine propulsion units and particularly outboard drives is a troublesome one. It is well known to discharge the exhaust gases from the powering engine through an underwater exhaust gas discharge so as to utilize the body of water in which the watercraft is operating as a silencing medium. Although this is a very acceptable and effective way for silencing exhaust gases under high speed running conditions, it does present certain problems in connection with low speed exhaust gas discharge. With an outboard motor, it is the common practice to provide a separate, above the water, exhaust gas discharge which has its own silencing system for treating the idling exhaust gases. With inboard/outboard drives, on the other hand, the powering engine usually has a larger displacement and the treatment of the exhaust gases during idling present different problems. It has been proposed with such arrangements to employ a further auxiliary exhaust gas discharge which is also underwater when the boat is traveling at low speeds but is less deeply submerged than the high speed exhaust gas discharge. Although this does provide good silencing, the exhaust gases tend to emanate in large bubbles which can cause objectionable noise.

It is, therefore, a principal object of this invention to provide an improved exhaust gas discharge for a marine propulsion unit.

It is a further object of this invention to provide an improved underwater exhaust discharge for a marine outboard drive.

It is a yet further object of this invention to provide an improved silencing arrangement for the idling gases of an outboard drive unit.

In addition to the problem of handling the exhaust gases in marine propulsion units, there is also the problem of galvanic corrosion. These problems are particularly acute when operating in a marine environment since the salt water greatly accelerates the effects of galvanic corrosion. Although it has been proposed to employ sacrificial anodes, the placement of the anode can cause considerable difficulties. The anode should be placed in an area where it will be in contact with the cooling water that flows through the engine and also should be positioned in an area where the galvanic action is most likely to occur. Inconsistent with these requirements is the desire to position the sacrificial anode in an area where it can be conveniently and quickly replaced.

It is, therefore, a still further object of this invention to provide an improved sacrificial anode construction for a marine outboard drive.

It is another object of this invention to provide an improved, readily removable and easily serviced sacrificial anode for a marine outboard drive.

SUMMARY OF THE INVENTION

A first feature of this invention is adapted to be embodied in a marine outboard drive that is comprised of a lower unit formed with an outer casing. An exhaust passage is formed within the outer casing and terminates in an outlet opening that is disposed below the level of water in which the associated watercraft is operating under at least some running conditions. A baffle plate is affixed to the outer housing and extends across the outlet opening for breaking up the size of exhaust gas bubbles emanating from the outlet opening for improving exhaust gas silencing.

Another feature of this invention is also adapted to be embodied in a marine outboard drive that is comprised of a lower unit formed with an outer casing. An exhaust gas passage is formed within the outer casing and terminates in an outlet opening that is disposed below the level of water in which the associated watercraft is operating under at least some normal operating conditions. In accordance with this feature of the invention, the outlet opening is formed at least in part by a sacrificial anode that is detachably affixed to the exterior of the outer housing for ready removal and replacement.

DETAILED DESCRIPTION OF THE PREFERRED EMBODIMENT

Figure 1:
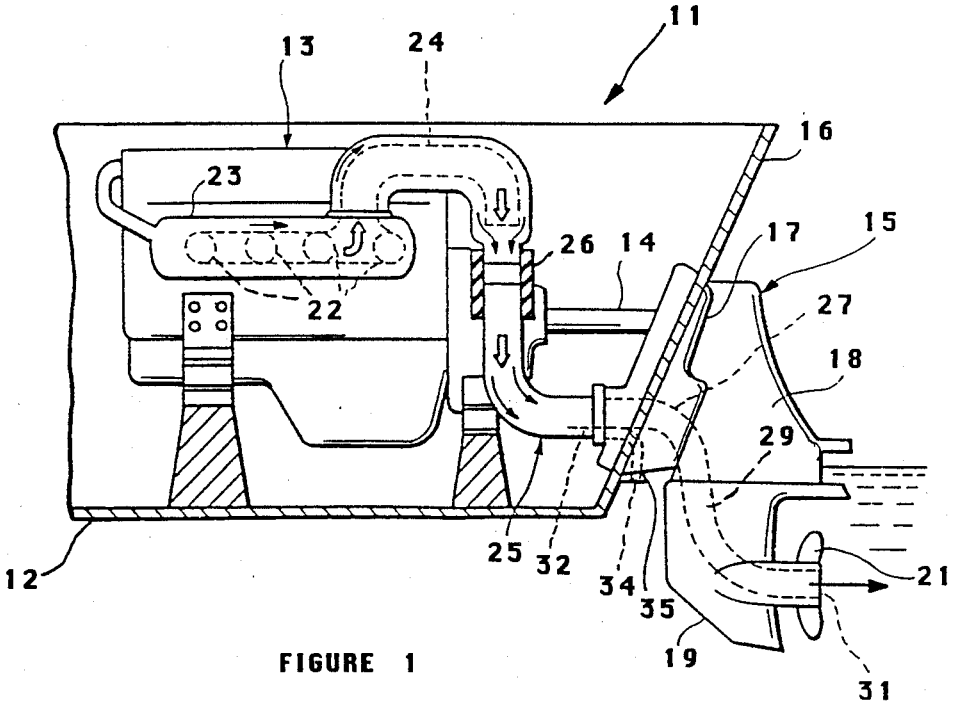
FIG. 1 is a side elevational view of a portion of a watercraft powered by an inboard/outboard drive constructed in accordance with an embodiment of the invention, with portions shown in section.

Referring now in detail to the drawings and initially primarily to FIG. 1, a watercraft powered by an inboard/outboard drive constructed in accordance with an embodiment of the invention is indicated generally by the reference numeral 11. The watercraft 11 is comprised of a hull 12 in which an internal combustion engine 13 of any known type is positioned. The engine 13 drives an input shaft 14, of an outboard drive unit, indicated generally by the reference numeral 15 and mounted on a transom 16 of the hull 12 in a known manner. This mounting arrangement provides for steering movement of the outboard drive unit 15 about a generally vertically extending axis and tilt and trim movement about a generally horizontally disposed axis. This mounting arrangement may be of any of the known types in this art and since it forms no part of the invention, it has not been illustrated nor will it be described.

Basically, however, the mounting arrangement includes a gimbal housing 17 that is affixed to the transom 16 and which supports a main housing 18 of the outboard drive unit 15. A lower unit 19 depends from the main housing 18 and mounts a propeller 21 that is driven by the input shaft 14 in any known manner.

The portion of the inboard/outboard drive as thus far described may be considered to be conventional and, for that reason, further description of it is not believed to be necessary to understand the construction and operation of the invention. The invention relates primarily to the exhaust system for the engine 13 and the manner of treatment of the exhaust gases.

Figure 2:
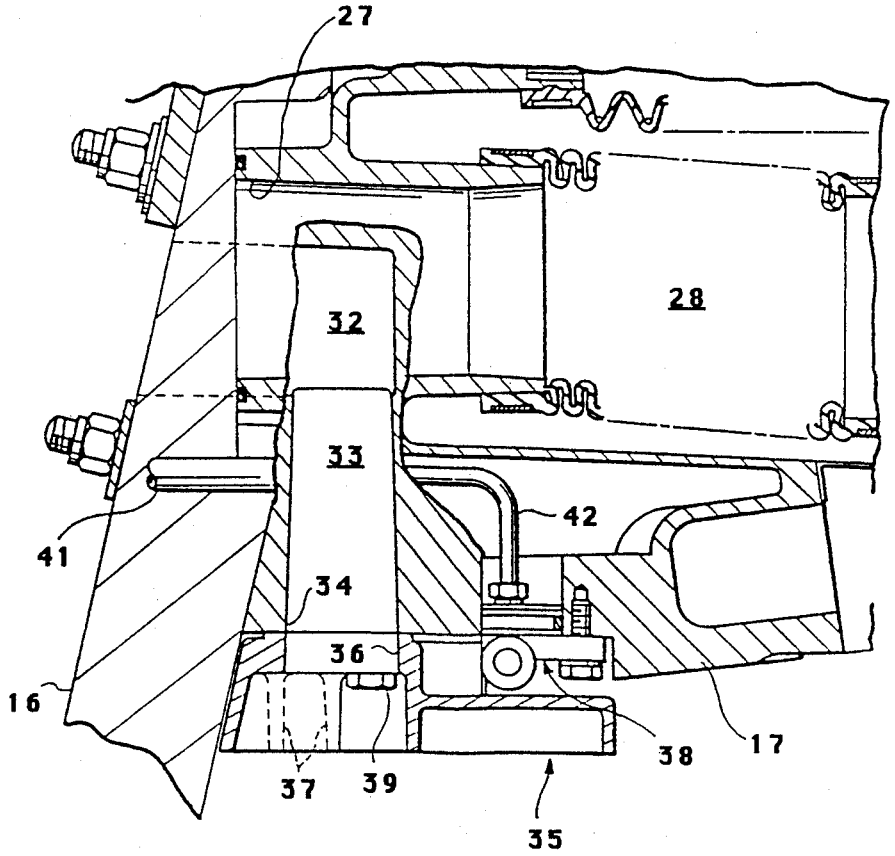
FIG. 2 is an enlarged cross-sectional view showing a portion of the exhaust gas discharge.
Figure 3:
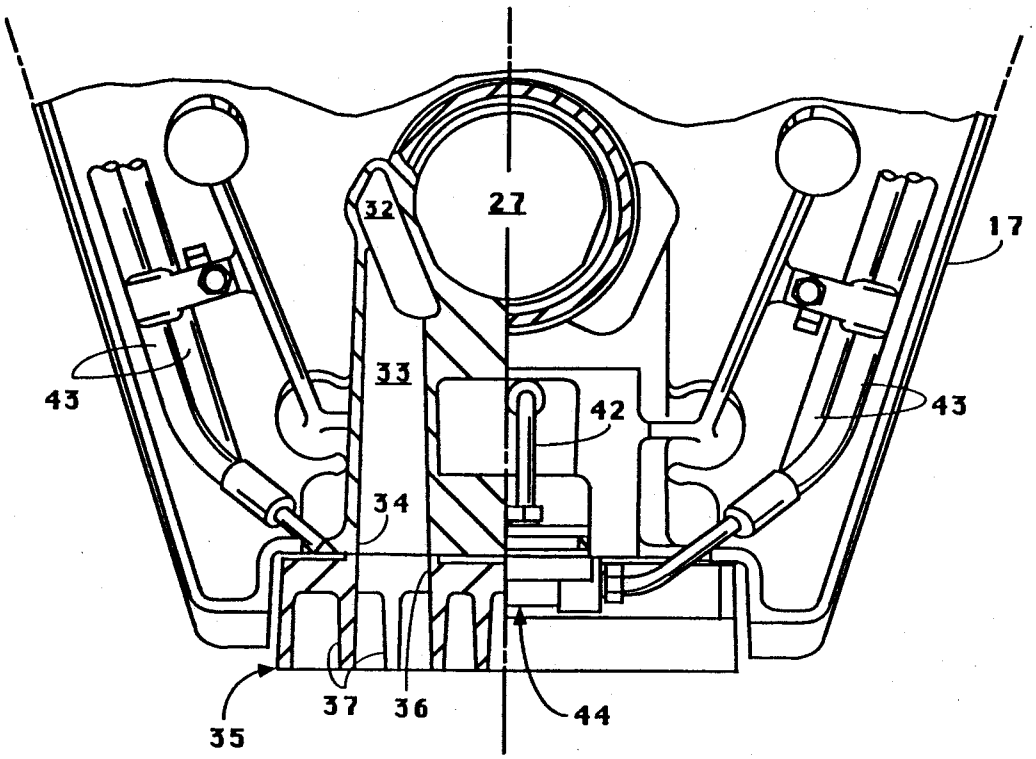
FIG. 3 is a rear elevational view of the outboard drive unit with a portion shown in cross-section and other portions broken away.

Referring now additionally to the remaining figures, the engine 13 has a plurality of exhaust ports 22 that open into an exhaust manifold 23 which is cooled by water from the cooling jacket of the engine 13 in a known manner. The exhaust gases flow from the manifold 23 into a conduit 24 in which the exhaust gases are mixed with the cooling water from the engine and discharged into a collector section 25 through a flexible coupling 26. The collector section 25 defines a main exhaust gas passageway that mates with a corresponding exhaust gas passageway 27 of the gimbal housing 17 (FIGS. 2 and 3). A flexible bellows 28 interconnects the gimbal housing passageway 27 with an exhaust gas passage 29 formed in the outboard drive housings 18 and 19 and which terminates in a through the hub exhaust gas discharge 31 of the propeller 21. Of course, other forms of high speed exhaust gas discharges may be employed.

The through the hub exhaust gas discharge opening 31 is extremely effective in silencing the high speed exhaust gases from the engine 13. However, when operating at lower speeds the degree of submersion of the underwater high speed discharge 31 is too great and the back pressure on the idling gases of the engine will be too high to allow efficient operation. For that reason, there is provided an idling exhaust gas discharge that is comprised of a pair of passages 32 that intersect at their inlet ends, the passage formed in the collector 25, and which terminate in a pair of downwardly facing passageways 33 that have outlet openings 34 formed at their lower ends. The outlet openings 34 are normally positioned beneath the water level when the watercraft is stationary, idling or under low speed running conditions. This construction, which is of the type generally employed in the prior art, is intended to provide exhaust gas silencing for low or idle running. However, the discharge of the idling exhaust gases causes rather large exhaust gas bubbles to form which are noisy when breaking up.

In accordance with the invention, therefore, there is provided a combined baffle and sacrificial anode, indicated generally by the reference numeral 35 which cooperates with the openings 34 so as to break up these bubbles and provide good silencing. In addition, the baffle 35 is formed from a material that is high on the activity chart, such as those materials that are normally used as sacrificial anodes, so as to also provide galvanic corrosion protection for the engine 13 and outboard drive unit 15.

Figure 4:
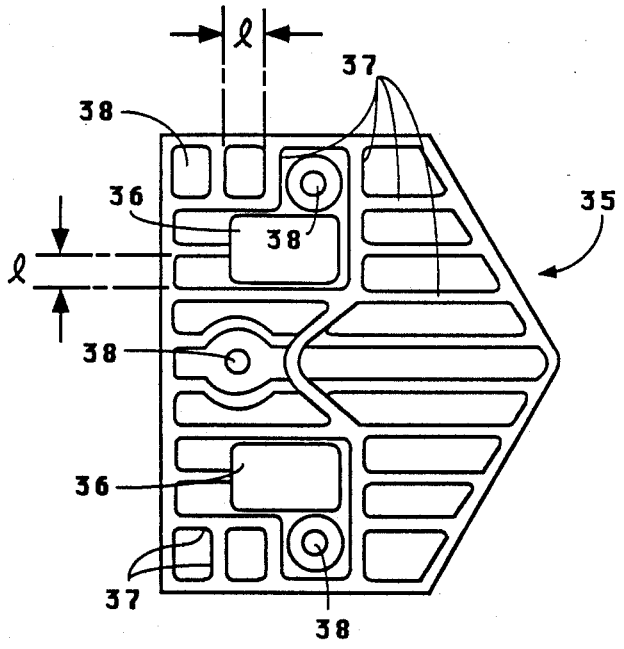
FIG. 4 is an enlarged bottom plan view of the exhaust gas discharge and anode.

As may be best seen in FIGS. 2 through 4, the baffle 35 is comprised of a pair of exhaust gas receiving openings 36 which are generally aligned with and register with the discharge openings 34 of the gimbal housing 17. The lower face of the baffle 35 is formed with a plurality of projecting ribs 37 that define a number of pockets 38 which, in effect, provide a labyrinth type device so that the exhaust gases must flow through a plurality of the pockets 38 before they can enter into the body of water in which the watercraft 11 is operating. As a result, the exhaust gas bubbles will be broken up into very small sizes and their rupturing will not cause any objectionable sounds. In addition, the use of the baffles formed by the ribs 37 provides additional silencing by itself so as to insure against any objectionable exhaust noises during idling.

The baffle plate 35 is formed with a pair of cylindrical openings 40 that are adapted to pass threaded fasteners 39 so as to afford a means of attachment to the underside of the gimbal housing 17. As a result, the sacrificial anode, baffle 35 may be conveniently removed and replaced as it becomes spent so as to facilitate replacement as it is sacrificed. Also, because the baffle plate and anode 35 is positioned in contact with the exhaust gas passageway, it will be in a high temperature area of the outboard drive unit 15 wherein corrosion is most likely to occur. As a result, the baffle plate 35 will also provide extremely good galvanic corrosion protection.

The tilt and trim movement of the outboard drive 15 is operated by means of a known type of hydraulic system that includes a supply conduit 41 that extends through the transom 16 of the watercraft and which connects with connecting pipes 42 through externally positioned hoses 43 and a coupler 44.

It should be readily apparent from the foregoing description that a very effective exhaust gas baffle has been provided which also serves the function as the sacrificial anode. Therefore, not only will the exhaust gases be effectively silenced, but corrosion protection is improved because the sacrificial anode is placed at a high temperature area wherein corrosion is most likely to occur. The device can be easily replaced and hence, servicing is greatly facilitated.

The foregoing description is, of course, only that of a preferred embodiment of the invention and various changes and modifications may be made without departing from the spirit and scope of the invention, as defined by the appended claims.

I claim:

1. A marine outboard drive comprised of a lower unit formed with an outer casing, an exhaust passage formed within said outer casing and terminating in an outlet opening disposed slightly below the level of water in which the associated watercraft is operating other than at high speeds and above the water at high speeds, and a baffle plate fixed against movement relative to said outer casing and extending across said outlet opening for restricting the effective size thereof and redirecting the flow of exhaust gases emanating from said outlet opening for breaking up the size of exhaust gas bubbles emanating from said outlet opening for improving gas silencing at low speeds.

2. A marine outboard drive as set forth in claim 1 wherein the outlet opening is downwardly facing.

3. A marine outboard drive comprised of a lower unit formed with an outer casing, an exhaust passage formed within said outer casing and terminating in an outlet opening disposed below the level of water in which the associated watercraft is operating under at least some operating conditions and comprising an idle exhaust gas discharge, a high speed exhaust gas discharge communicating with the exhaust passage and discharging into the body of water at a substantially lower level than said outlet opening and a baffle plate affixed to said outer casing and extending across said outlet opening for breaking up the size of exhaust gas bubbles emanating from said outlet opening improving exhaust gas silencing at idle.

4. A marine outboard drive as set forth in claim 3 wherein the baffle plate comprises a plate extending across the outlet opening, said plate having a lower cross-sectional area forming an opening and formed with a plurality of ribs defining pockets through which the exhaust gases must pass from the outlet opening before they can reach the body of water and be discharged through the body of water to the atmosphere, said plate lower cross-sectional area being substantially greater than the cross-sectional area of said outlet opening.

5. A marine outboard drive as set forth in claim 4 wherein the baffle plate is formed from a material acting as a sacrificial anode.

6. A marine outboard drive comprised of a lower unit formed with an outer casing, an exhaust passage formed within said outer casing and terminating in an outlet opening disposed below the level of water in which the associated watercraft is operating under at least some operating conditions, and a baffle plate affixed to said outer casing and extending across said outlet opening for breaking up the size of exhaust bubbles emanating from said outlet opening for improving exhaust gas silencing, said baffle plate being formed from a material acting as a sacrificial anode.

7. A marine outboard drive comprised of a lower unit formed with an outer casing, an exhaust passage formed within said outer casing and terminating in an outlet opening disposed below the level of water in which the associated watercraft is operating under at least some operating conditions, and a sacrificial anode detachably affixed to said outer casing and defining an extension of the outlet opening for discharging of the exhaust gases from the outlet opening into the body of water in which the watercraft is operating through the sacrificial anode.

8. A marine outboard drive as set forth in claim 7 wherein the sacrificial anode defines a labyrinth type passage through which the exhaust gases must flow from the outlet opening to the atmosphere.

* * * * *